US010196725B2

(12) United States Patent
Janschek et al.

(10) Patent No.: US 10,196,725 B2
(45) Date of Patent: Feb. 5, 2019

(54) METHOD FOR THE PRODUCTION OF A HIGHLY STRESSABLE COMPONENT FROM AN α+γ-TITANIUM ALUMINIDE ALLOY FOR RECIPROCATING-PISTON ENGINES AND GAS TURBINES, ESPECIALLY AIRCRAFT ENGINES

(71) Applicant: LEISTRITZ Turbinentechnik GmbH, Remscheid (DE)

(72) Inventors: Peter Janschek, Düsseldorf (DE); Marianne Baumgartner, Nürnberg (DE)

(73) Assignee: LEISTRITZ TURBINENTECHNIK GMBH, Remscheid (DE)

( * ) Notice: Subject to any disclaimer, the term of this patent is extended or adjusted under 35 U.S.C. 154(b) by 334 days.

(21) Appl. No.: 15/065,328

(22) Filed: Mar. 9, 2016

(65) Prior Publication Data

US 2016/0265096 A1 Sep. 15, 2016

(30) Foreign Application Priority Data

Mar. 9, 2015 (DE) ..... 10 2015 103 422

(51) Int. Cl.

| | |
|---|---|
| ***C21D 1/26*** | (2006.01) |
| ***C21D 1/30*** | (2006.01) |
| ***C21D 8/00*** | (2006.01) |
| ***C21D 9/00*** | (2006.01) |
| ***C22F 1/00*** | (2006.01) |
| ***C22F 1/02*** | (2006.01) |
| ***C22F 1/16*** | (2006.01) |
| ***C22F 1/18*** | (2006.01) |
| ***C22C 14/00*** | (2006.01) |
| ***C22C 30/00*** | (2006.01) |

(52) U.S. Cl.

CPC ..... *C22F 1/183* (2013.01); *C21D 1/26* (2013.01); *C21D 1/30* (2013.01); *C21D 8/00* (2013.01); *C21D 9/0068* (2013.01); *C22C 14/00* (2013.01); *C22C 30/00* (2013.01); *C22F 1/002* (2013.01); *C22F 1/02* (2013.01); *C22F 1/16* (2013.01)

(58) Field of Classification Search

CPC .... C22F 1/183; C22F 1/16; C22F 1/02; C22F 1/002; C21D 1/26; C21D 1/30; C21D 9/0068; C21D 8/00; C22C 30/00; C22C 14/00

See application file for complete search history.

(56) References Cited

U.S. PATENT DOCUMENTS

| | | | | |
|---|---|---|---|---|
| 4,710,348 | A * | 12/1987 | Brupbacher | C22C 32/00 420/129 |
| 5,299,353 | A | 4/1994 | Nazmy | |
| 5,328,530 | A * | 7/1994 | Semiatin | C22F 1/00 148/559 |
| 5,372,663 | A * | 12/1994 | Shibue | B22F 3/12 148/669 |
| 6,521,059 | B1 * | 2/2003 | Nazmy | C22F 1/10 148/421 |
| 6,997,995 | B2 * | 2/2006 | Janschek | C22F 1/183 148/421 |
| 8,668,760 | B2 * | 3/2014 | Achtermann | C22B 9/20 164/495 |
| 8,828,160 | B2 | 9/2014 | Kremmer | |
| 8,864,918 | B2 | 10/2014 | Clemens | |
| 8,888,461 | B2 * | 11/2014 | Smarsly | C22F 1/183 415/200 |
| 2007/0034350 | A1 | 2/2007 | Renkel | |
| 2011/0277891 | A1 * | 11/2011 | Clemens | C22C 1/02 148/670 |
| 2014/0202601 | A1 | 7/2014 | Helm | |
| 2016/0265096 | A1 | 9/2016 | Janschek | |

FOREIGN PATENT DOCUMENTS

| | | | |
|---|---|---|---|
| DE | 10150674 | A1 | 7/2002 |
| DE | 10150674 | | 2/2008 |
| DE | 102007051499 | | 4/2009 |
| EP | 112799 | A1 | 7/1984 |
| EP | 1127949 | A2 | 8/2001 |
| EP | 1649954 | A2 | 4/2006 |
| EP | 2251445 | A1 | 11/2010 |
| EP | 2386663 | | 11/2011 |
| EP | 2386663 | A1 | 11/2011 |
| EP | 3012337 | A1 | 4/2016 |
| JP | H08283890 | A | 10/1996 |
| JP | 2011236503 | A | 11/2011 |
| JP | 2015004092 | A | 1/2015 |
| WO | 2013020548 | A1 | 7/2014 |

OTHER PUBLICATIONS

European Search Report from corresponding EP Application No. 16153407.8; dated Jul. 18, 2016 (6 pages).

Tiebang, Zhang, "Hot Workability and Microstructure Evolution of TiAl Alloy in (a2+y) Dual-phase Field" ScienceDirect—Rare Metal Materials Engineering, vol. 42, Online English edition of the Chinese language journal, vol. 42(7), Jul. 7, 2013 Ursprunglicher Dateiname.

(Continued)

*Primary Examiner* — Anthony J Zimmer

(74) *Attorney, Agent, or Firm* — Lucas & Mercanti, LLP

(57) ABSTRACT

A method for the production of a highly stressable component from an α+γ-titanium aluminide alloy for reciprocating-piston engines and gas turbines, especially for aircraft engines, characterized in that the alloy used is a TiAl alloy with the following composition (in atom %):

40-48% Al;
2-8% Nb;
0.1-9% of at least one β-phase-stabilizing element selected from Mo, V, Ta, Cr, Mn, Ni, Cu, Fe, Si;
0-0.5% B; and
a remainder of Ti and smelting-related impurities, wherein the deformation is carried out in a single stage starting from a preform with a volume distribution varying over the longitudinal axis, wherein the component is deformed isothermally in the β-phase region at a logarithmic deformation rate of 0.01-0.5 1/s.

24 Claims, No Drawings

(56) References Cited

OTHER PUBLICATIONS

Fei, Yang, "Effect of Heat Treatment on Microstructure and Properties of as-Forged TiAl Alloy with ~ Phase" ScienceDirect—Rare Metal Materials and Engineering, vol. 40, Online English edition of the Chinese language journal, vol. 40, Sep. 9, 2011 Ursprunglichter Dateiname.
ASM International, "ASM Handbook, vol. 14, Forming and Forging" ASM International, 1996, Ed. 4eme fichier electronique originel.
Clemens , Helmut et al., "Materials for Aircraft Engines" Sep. 3, 2011 , [cite25 .. 04.2018J fichier electronique originel.
ASM International, "Handbook of workability and process design" George E. Dieter, Howard A. Kuhn, S. Lee Semiatin, 2003 en particulier : extrait du chapitre 2 "Bulk workability of Metals" fichier electronique originel.
Huang, Zhao-Hui et al., "Isothermal forging of Y-TiAl based alloys" Transf. Nonferrous Met. Soc. China, vol. 13, No. 6, Dec. 2003 fichier electronique original.
Zhang, Z et al. , "Process Optimization for Isothermal Forging of TiAl Compressor Blade by Numerical Simulation" 2010 2nd International Conference on Computer Engineering and Technology, vol. 5, 2010 en particulier : pp. 412-415 fichier electronique original.
Abkowitz , Stanley et al., "Titanium in Industry" D. Van Nostrand Company, Inc, 1955 fichier electronique original.
Extra it d'un catalogue de GfE, y-TiAl TNM-Ingot, Mar. 2010 fichier electronique origin el.
Programme du "7th European Winter School on Neutrons and Synchrotron Radiation" fichier electronique originel.
Programme du "International Workshop on Gamma Alloy Technology, Toulouse, France, Jun. 11-14, 2013" fichier electronique originel.
Jacques Tschoffen et al., Development of forging processes for TiAl engine components for aerospace and automotive industries, fichier electronique originel.

* cited by examiner

METHOD FOR THE PRODUCTION OF A HIGHLY STRESSABLE COMPONENT FROM AN α+γ-TITANIUM ALUMINIDE ALLOY FOR RECIPROCATING-PISTON ENGINES AND GAS TURBINES, ESPECIALLY AIRCRAFT ENGINES

CROSS-REFERENCE TO RELATED APPLICATIONS

The present application claims priority of DE 10 2015 103 422.0, filed Mar. 9, 2015, the priority of this application is hereby claimed and this application is incorporated herein by reference.

BACKGROUND OF THE INVENTION

The invention pertains to a method for the production of a highly stressable component from an α+γ-titanium aluminide alloy for reciprocating-piston engines and gas turbines, especially for aircraft engines.

Alloys based on TiAl belong to the group of the intermetallic materials, which were developed for applications at the working temperatures where superalloys are currently being used. Because of their low density of about 4 g/cm$^3$, this material offers considerable potential for weight reduction and for the reduction of the stresses of moving parts such as the blades and disks of gas turbines or components of piston engines at temperatures of up to approximately 700° C. The precision casting of turbine blades for aircraft engines, for example, belongs to the prior art. For applications with even greater loads such as those on the high-speed turbines for the new geared turbofan aircraft engines, the properties of the cast structure are no longer sufficient. By means of thermomechanical treatment involving plastic forming with a defined degree of deformation followed by a heat treatment, the static and dynamic properties of TiAl alloys can be increased to the required values. Nevertheless, TiAl alloys, because of their high deformation resistance, cannot be forged in the conventional way. Therefore, the forming processes must be carried out at high temperatures in the area of the α+γ- or α-phase region under a shield atmosphere at low deformation rates. To achieve the desired final geometry of the forging, it is usually necessary to perform several forging steps in succession.

One example of a method of this type for the production of highly stressable components from α+γ-TiAl alloys is known from DE 101 50 674 B4. In this method, components intended in particular for aircraft engines or stationary gas turbines are produced by forming encapsulated TiAl blanks with a globular microstructure by primary isothermal deformation in the α+γ-phase region at temperatures in the range of 1,000-1,340° C. or in the α-phase region at temperatures in the range of range of 1,340-1,360° C. by forging or extrusion, after which the preforged parts are forged into their final shape in at least one secondary isothermal deformation process in the α+γ-phase or α-phase region at temperatures in the range of 1,000-1,340° C. under simultaneous dynamic recrystallization to obtain the component with the specified contour, after which the component is solution-annealed in the α-phase region to set the microstructure and then quickly cooled. A two-stage process is therefore carried out, comprising a primary deformation in the α+γ- or α-phase region, followed by a secondary deformation under simultaneous recrystallization. A two-stage process of this type, however, is extremely costly.

SUMMARY OF THE INVENTION

The invention is therefore based on the goal of providing a method for the production of a highly stressable component from an α+γ-titanium aluminide alloy which is easier to realize than the methods known so far.

To solve this problem, a method according to the invention for the production of a highly stressable component from an α+γ-titanium aluminide alloy for reciprocating-piston engines and gas turbines, especially for aircraft engines, is proposed, which is characterized in that, as the ahoy, a TiAl alloy of the following composition (in atom %) is used 40-48% Al;
2-8% Nb;
0.01-9% of at least one β-phase stabilizing element selected from Mo, V, Ta, Cr, Mn, Ni, Cu, Fe, Si;
0-0.5% B; and
a remainder of Ti and smelting-related impurities, wherein the deformation is carried out in a single stage starting from a preform with a volume distribution varying over the longitudinal axis, wherein the component is deformed isothermally in the β-phase region at a logarithmic deformation rate of 0.01-0.5 1/s.

The method according to the invention is characterized by a single-stage, isothermal deformation process of the component in the β-phase region at a slow deformation rate, wherein a specific TiAl alloy is used which makes it possible to stabilize the component in the β-phase region, so that the deformation can be carried out there. For this purpose, the alloy contains an appropriate amount of at least one element which can stabilize the β-phase, this element being selected from the group Mo, V, Ta, Cr, Mn, Ni, Cu, Fe, and Si, wherein mixtures of these can also be used. During the slow deformation at a logarithmic deformation rate of 0.01-0.5 1/s at high temperature, the 12 slip planes existing in the cubic space-centered β-phase are activated, and a dynamic recrystallization is initiated. By means of the continuous input of additional deformation energy, this recrystallization is induced to continue over the entire course of the deformation. Because of the lower yield stress, a fine-grained microstructure is thus formed. When, in contrast, deformation is carried out in the α+γ- or α-phase region as described in DE 101 50 674 A1, the hexagonal phase structure is present, and therefore there is only one slip plane, which necessitates a two-stage deformation process. In contrast, the method according to the invention advantageously allows a single-stage deformation, wherein, upon completion of this single deformation process, the forging has its finished shape The elements Mo, V, and Ta are especially preferred as β-phase-stabilizing elements; they can be used either individually or as a mixture.

The content of the β-phase-stabilizing element is preferably in the range of 0.1-2%, especially 0.8-1.2%. This is especially the case when Mo, V, and/or Ta is used, because these have an especially strong stabilizing property and therefore their content can be kept relatively low.

An alloy of the following composition is preferably used:

41-47% Al,
1.5-7% Nb,
0.2-8% of at least one β-phase-stabilizing element selected from Mo, V, Ta, Cr, Mn, Ni, Cu, Fe, Si;
0-0.3% B; and
a remainder of Ti and smelting-related impurities.

To describe the invention in even more concrete terms, an alloy of the following composition is preferably used:

42-46% Al;

2-6.5% Nb;

0.4-5% of at least one β-phase-stabilizing element selected from Mo, V, Ta, Cr, Mn, Ni, Cu, Fe, Si;

0-0.2% B; and a remainder of Ti and smelting-related impurities.

An alloy of the following composition is especially preferred:

42.8-44.2% Al;

3.7-4.3% Nb;

0.8-1.2% Mo;

0.07-0.13% B; and and a remainder of Ti and smelting-related impurities.

The deformation temperature in the β-phase region is preferably 1,070-1,250° C., wherein, as described above, the deformation is carried out under isothermal conditions; that is, the forming tools are held at the deformation temperature so the work can be carried out without leaving the required narrow temperature window. The logarithmic deformation rate is $10^{-3}$ $s^{-1}$–$10^{-1}$ $s^{-1}$.

DETAILED DESCRIPTION OF THE INVENTION

The preform which is used comprises a volume distribution which varies over the longitudinal axis; that is, a predetermined basic 3-dimensional shape is already present, from which, by means of the single-stage deformation according to the invention, the finished component is forged. This preform is preferably produced by casting, by metal injection molding (MIM), by additive methods (3D-printing, laser build-up welding, etc.) or by a combination of the possibilities just mentioned.

Tools of a highly heat-resistant material are preferably used for the deformation, preferably tools of an Mo alloy. During the deformation process, the tools are advisably protected from oxidation by an inert atmosphere. To keep the tools at the deformation temperature, they are preferably actively heated by induction, for example, or by resistance heating.

The preform is also heated before the deformation process in a furnace, for example, or by induction or by resistance heating.

The deformation is preferably followed by a heat treatment of the formed component to arrive at the required performance characteristics and for this purpose to convert the β-phase, which is favorable for the deformation, into a fine-lamellar α+γ-phase by means of a suitable heat treatment. The heat treatment can comprise a recrystallization annealing at a temperature of 1,230-1,270° C. The hold time during the recrystallization annealing is preferably 50-100 minutes. The recrystallization annealing is carried out in the region of the γ/α transformation temperature. If, as also provided by the invention, the component is cooled to a temperature of 900-950° C. in 120 s or even more quickly after the recrystallization annealing, a close interlamellar spacing of the α+γ-phase will be formed.

A second heat treatment is preferably carried out next, in which the component is first cooled to room temperature and then heated to a stabilizing or stress-relieving temperature of 850-950° C. Alternatively, it is also possible to proceed directly from the temperature of 900-950° C. quickly reached after the recrystallization annealing as previously described to the stabilizing and stress-relieving temperature of 850-950° C. The preferred hold time at the stabilizing and stress-relieving temperature, regardless of how this temperature is reached, is preferably 300-360 minutes.

Upon completion of the hold time, the component temperature is preferably lowered to below 300° C. at a defined cooling rate. The cooling rate is preferably 0.5-2 K/min; that is, the cooling proceeds relatively slowly, which serves to stabilize and stress-relieve the microstructure. The cooling rate is preferably 1.5 K/min.

The cooling step in question can be carried out in a liquid such a oil or in air or in an inert gas.

In addition to the method according to the invention, the invention also pertains to a component made of an α+γ-titanium aluminide alloy, especially for a reciprocating-piston engine, an aircraft engine, or a gas turbine, which is produced by a method of the type described here. A component of this type can be, for example, a blade or a disk of a gas turbine or the like.

We claim:

1. A method for the production of a highly stressable component from an α+γ-titanium aluminide alloy for reciprocating-piston engines and gas turbines, wherein the alloy used is a TiAl alloy with the following composition (in atom %):

40-48% Al;

2-8% Nb;

0.1-9% of at least one β-phase-stabilizing element selected from Mo, V, Ta, Cr, Mn, Ni, Cu, Fe, Si;

0-0.5% B; and a remainder of Ti and smelting-related impurities, wherein a deformation is carried out in a single stage starting from a preform with a volume distribution varying over the longitudinal axis, wherein the component is deformed isothermally in the β-phase region at a logarithmic deformation rate of 0.01-0.5 1/s.

2. The method according to claim 1, wherein only Mo, V, Ta, or a mixture thereof is present in the alloy as the β-phase-stabilizing element.

3. The method according to claim 1, wherein the content of the β-phase-stabilizing element is 0.1-2%.

4. The method according to claim 3, wherein the content of the β-phase-stabilizing element 0.8-1.2%.

5. The method according to claim 1, wherein a TiAl alloy of the following composition is used:

41-47% Al;

1.5-7% Nb;

0.2-8% of at least one β-phase-stabilizing element selected from Mo, V, Ta, Cr, Mn, Ni, Cu, Fe, Si:

0-0.3% B; and a remainder of Ti and smelting-related impurities.

6. The method according to claim 1, wherein a TiAl alloy of the following composition is used:

42-46% Al;

2-6.5% Nb;

0.4-5% of at least one β-phase-stabilizing element selected from Mo, V, Ta, Cr, Mn, Ni, Cu, Fe, Si;

0-0.2% B; and a remainder of Ti and smelting-related impurities.

7. The method according to claim 1, wherein an alloy of the following composition is used:

42.8-44.2% Al, 3.7-4.3% Nb 0.8-1.2% Mo;

0.07-0.13% B; and a remainder of Ti and smelting-related impurities.

8. The method according to claim 1, wherein the deformation temperature in the β-phase region is 1,070-1,250'C.

9. The method according to claim 1, wherein the preform is produced by casting, by metal injection molding (MIM), by additive methods, especially 3D-printing or laser build-up welding, or by a combination thereof.

10. The method according to claim 1, wherein tools of a highly heat-resistant material are used for the deformation.

11. The method according to claim 10, wherein tools of an Mo alloy are used.

12. The method according to claim 10, wherein the tools are protected by an inert atmosphere during the deformation process.

13. The method according to claim 10, wherein the tools used for the deformation are actively heated.

14. The method according to claim 13, wherein the tools are heated by induction.

15. The method according to claim 1, wherein the preform is heated in a furnace, by induction, or by resistance heating prior to the deformation.

16. The method according to claim 1, wherein the deformation is followed by a heat treatment of the formed component.

17. The method according to claim 16, wherein the heat treatment comprises a recrystallization annealing at a temperature of 1,230-1,270° C.

18. The method according to claim 17, wherein the hold time during the recrystallization annealing is 50-100 minutes.

19. The method according to claim 16, wherein, after the recrystallization annealing, the component is cooled to a temperature of 900-950° C. in 120 seconds or less.

20. The method according to claim 19, wherein the heat treatment is followed by a second heat treatment in which the component is cooled to room temperature and then heated to a stabilizing and stress-relieving temperature of 850-950° C., or in that the component is held at a stabilizing and stress-relieving temperature of 850-950° C. without previous cooling.

21. The method according to claim 20, wherein the hold time at the stabilizing and stress-relieving temperature is 300-360 minutes.

22. The method according to claim 20, wherein a cooling of the component to a temperature below 300° C. at a cooling rate of 0.5-2 K/min is then earned out.

23. The method according to claim 22, wherein the cooling rate is 1.5 K/min.

24. A component made of an $\alpha+\gamma$-titanium aluminide alloy, for a reciprocating piston engine, an aircraft engine, or a gas turbine, produced according to the method according to claim 1.

* * * * *